US006498313B1

(12) United States Patent
Stencel et al.

(10) Patent No.: US 6,498,313 B1
(45) Date of Patent: Dec. 24, 2002

(54) ELECTROSTATIC PARTICLE SEPARATION SYSTEM, APPARATUS, AND RELATED METHOD

(75) Inventors: John M. Stencel, Versailles, KY (US); John L. Schaefer, Lexington, KY (US); James K. Neathery, Lexington, KY (US); Heng Ban, Lexington, KY (US); Dennis Finseth, Pittsburgh, PA (US)

(73) Assignee: University of Kentucky Research Foundation, Lexington, KY (US)

( * ) Notice: Subject to any disclaimer, the term of this patent is extended or adjusted under 35 U.S.C. 154(b) by 0 days.

(21) Appl. No.: 09/470,916

(22) Filed: Dec. 23, 1999

(51) Int. Cl.[7] ..... B03C 7/00
(52) U.S. Cl. ..... 209/131; 209/129
(58) Field of Search ..... 209/127.1, 127.4, 209/128, 131, 906, 129, 130; 406/191, 195

(56) References Cited

U.S. PATENT DOCUMENTS

| | | | | |
|---|---|---|---|---|
| 1,221,505 A | | 4/1917 | Bradley et al. | |
| 1,361,137 A | | 12/1920 | Chapman et al. | |
| 2,782,923 A | | 2/1957 | Cook, Jr. et al. | |
| 3,493,109 A | | 2/1970 | Carta et al. | |
| 3,853,750 A | | 12/1974 | Volsy | |
| 3,901,799 A | * | 8/1975 | Adkison | 209/144 |
| 4,588,423 A | | 5/1986 | Gillingham et al. | |
| 4,839,032 A | | 6/1989 | Whitlock | |
| 4,874,507 A | | 10/1989 | Whitlock | |
| 5,289,921 A | | 3/1994 | Rodrigo et al. | |
| 5,397,066 A | * | 3/1995 | Leitman et al. | 241/19 |
| 5,570,789 A | | 11/1996 | Dunn | |
| 5,626,652 A | * | 5/1997 | Kohl et al. | 96/45 |
| 5,755,333 A | * | 5/1998 | Stencel et al. | 209/127.1 |
| 5,938,041 A | * | 8/1999 | Stencel et al. | 209/127.1 |
| 6,034,342 A | * | 3/2000 | Schmoutziguer et al. | 209/127.1 |

FOREIGN PATENT DOCUMENTS

| | | | |
|---|---|---|---|
| SE | 9604552-1 | * | 8/1998 |
| SU | 1085633 | * | 4/1984 |

OTHER PUBLICATIONS

Ban, Heng, et al., "Dry Triboelectrostatic Beneficiation of Fly Ash," 1996 Proc. International Utilization Symposium, (1996).

Li, T.X., et al., "Dry Triboelectrostatic Separation of Mineral Particles: A Potential Application in Space Exploration," Journal of Electrostatics: Fundamentals, Applications and Hazards, Elsevier Science, No. 47, p. 133–142, (1999).

* cited by examiner

*Primary Examiner*—Donald P. Walsh
*Assistant Examiner*—Joseph C. Rodriguez
(74) *Attorney, Agent, or Firm*—King & Schickli, PLLC

(57) ABSTRACT

An electrostatic separation apparatus or system is provided for separating a particle mixture into two constituent species. The system includes a distributor for differentially tribocharging the particle species forming the mixture and supplying the charged mixture to a plurality of electrostatic separation cells. Each cell includes at least one separator having an inlet, a separation chamber having an electric field zone for drawing selected charged particles from the particle mixture, a collector, and a transition outlet. The length of the electric field zone is selectively adjustable for varying the charged particle drawing action. A curtain gas flow introduced into the separation chamber carries the selected charged particles drawn from the particle mixture in the electric field zone to the collector. Flow vanes or straighteners are provided for both the particle mixture flow and the curtain gas flow to reduce turbulence in the separation chamber and improve separation efficiency. The collector includes a discharge outlet for discharging the selected charged particles to a first collection bin. The transition outlet receives the remaining particle flow and delivers it to a second collection bin for recovery or to a second separator to collect any remaining selected charged particles. The transition outlet reforms the flow to create turbulence to further tribocharge the particles prior to entering the second separator. A related method of particle separation is also disclosed.

23 Claims, 5 Drawing Sheets

14
16
TO CURTAIN GAS INLETS
20
18
22
116
26
24
10
12
24
10
28
118
58
104
102
108
114
106
110
100
78
109
115
112

FROM FEED LINE 40
38
26
CG
32
44
$P_2$
34
$P_1$
36
36
52
50
$P_1$
48
$P_1$
49
P'
P'T
62
68
60
FIRST COLLECTION DEVICE

ELECTROSTATIC PARTICLE SEPARATION SYSTEM, APPARATUS, AND RELATED METHOD

TECHNICAL FIELD

The present invention relates generally to the material separation art and, more particularly, to a particle separation system, including an improved electrostatic separation apparatus, and a related method for electrostatically separating two species of particles present in a particle mixture.

BACKGROUND OF THE INVENTION

Various types of apparatus for removing particles from a dry fluid flow using electrostatic separation techniques are well known in the art. An early example of such an apparatus is shown in U.S. Pat. No. 3,493,109 to Carta et al., the operation and limitations of which are described in detail in commonly assigned U.S. Pat. No. 5,755,333, issued May 26, 1998. Generally speaking, the Carta et al. patent relies upon turbulent flow and particle-wall contact in the separation chamber to electrostatically charge the particles. The particles are then drawn from the flow by opposed electrically conductive plates having opposite polarities.

While the apparatus proposed in the Carta et al. reference is somewhat effective for separating particles having a selected charge from a particle mixture, several significant limitations remain. For instance, no effective means is disclosed to ensure that once separated, the selected particles will be directed to the appropriate collection device. To the contrary, the apparatus disclosed in the Carta et al. patent promotes turbulent flow in the separation chamber, which can allow deleterious re-mixing of the particles to occur after separation. As should be appreciated, this reduces efficiency to the point that several cycles or passes through the apparatus may be required to achieve separation. In addition to reducing efficiency, multiple passes significantly increase the particle abrasion to which the wall of the apparatus is subjected thereby reducing the service life of the separator.

In an effort to overcome this shortcoming, commonly assigned U.S. patent application Ser. No. 08/726,255, entitled "Apparatus and Method for Triboelectrostatic Separation," proposes an improved apparatus for separating two species of particles from a particle mixture with greater efficiency and effectiveness by using a curtain gas flow to carry the selected particles drawn from the mixture to a collector for recovery. Similar to the apparatus proposed in the Carta et al. patent, separation is effected through the use of oppositely charged conductor plates connected to a variable voltage source. The charged plates attract oppositely charged particles away from the mixture and towards the sidewalls of the separation chamber. The curtain gas flow (which is initially devoid of particles) is then introduced into the separation chamber to provide the cleaning action necessary to remove or sweep the particles from the plates for recovery.

While this apparatus is effective for separating two particle species from a particle mixture, it should be appreciated that further improvements in separation effectiveness and operational efficiency are still possible. More specifically, there is a need for an electrostatic separation apparatus that: (1) reduces turbulence in the separation chamber created by the mixing of the particle and curtain gas flows to ensure that more selected particles are separated from the particle mixture and collected for recovery; (2) enhances particle separation efficiency by permitting adjustments to be made to the length of the electric field during operation; and/or (3) includes serial separators in each apparatus to ensure that the particle species are fully separated in a single pass. Additionally, including a plurality of the electrostatic separation apparatus meeting these criteria in a system fed by a single distributor would improve operating efficiency and greatly increase the throughput or volume of the particle mixture that can be processed in a given time period.

SUMMARY OF THE INVENTION

Accordingly, it is a primary object of the present invention to provide an improved apparatus for electrostatically separating two species of particles from a particle mixture that overcomes the above-identified limitations and shortcomings of the prior art.

Another object of the present invention is to provide a particle separation system including a single distributor for simultaneously supplying the particle mixture to a plurality of individual electrostatic separation apparatus, whereby two distinct and substantially pure particle species are recovered from each apparatus.

Still another object of the present invention is to provide an electrostatic separation apparatus having multiple separators in series for removing and collecting selected charged particles from a particle mixture, whereby after passing the particle mixture through said multiple separators, two distinct and substantially pure species of particles are fully recovered.

Yet another object of the present invention is to provide an electrostatic separation apparatus that includes flow straighteners for both the particle mixture and curtain gas flows to reduce turbulence in the separation chamber and improve separation efficiency.

A further object of the present invention is to provide an electrostatic separation apparatus having at least one separation chamber wherein the length of the electric field zone is selectively adjustable for varying the quantity and quality of the selected charged particles that are drawn from the particle mixture.

Additional objects, advantages and other novel features of the invention will be set forth in part in the description that follows and in part will become apparent to those skilled in the art upon examination of the following or may be learned with the practice of the invention. The objects and advantages of the invention may be realized and obtained by means of the instrumentalities and combinations particularly pointed out in the appended claims.

To achieve the foregoing and other objects, and in accordance with the purposes of the present invention as described herein, an improved electrostatic separation apparatus is disclosed and use of this apparatus as part of an overall particle separation system is described. In the broadest aspects of the invention, the improved electrostatic separation apparatus includes at least one separator having an electrostatic separation chamber. Preferably, the separator is cylindrical and has a first inlet that receives a particle mixture entrained in a dry driving fluid, such as air. The inlet is designed to create a spiraling, turbulent flow that assists in generating a differential charge on the two constituent species of particles present in the mixture prior to delivery to the separation chamber.

The separation chamber includes an electric field zone for drawing particles having a selected charge from the mixture. Specifically, a concentric electrode and conductor at different electric potentials are provided in the separation chamber to create a non-uniform electric field zone. A variable voltage source may be connected to the electrode and conductor to control the polarity and magnitude of the voltage applied to each. Alternatively, the potential difference may be created by connecting the variable voltage source to the conductor and grounding the electrode. Depending on the charge and amount of voltage applied to the conductor and the electrode, the difference in potential across the non-uniform electric field creates an electric field force vector that draws particles having a selected charge away from the particle mixture flow.

To remove or sweep the selected charged particles drawn from the particle mixture in the electric field zone, a flow of curtain gas is provided. Specifically, a curtain gas chamber concentric with the first inlet includes a first curtain gas inlet for supplying a first curtain gas flow to the separation chamber. The curtain gas entrains the particles drawn from the mixture and carries them to a first collector for recovery.

In accordance with an important aspect of the present invention, improved separation efficiency is provided by substantially eliminating turbulent flow in the separation chamber. Specifically, the first inlet includes flow vanes to straighten and smooth the particle mixture flow prior to entering the separation chamber. Likewise, flow straighteners near the exit of the curtain gas chamber ensure that the curtain gas entering the separation chamber is smooth and substantially parallel to the particle mixture flow. Advantageously, the smooth, parallel flows of the particle mixture and curtain gas keep turbulence at a minimum, which improves separation efficiency. Additionally, the flows of the curtain gas and the particle mixture are preferably metered to ensure that both are at substantially the same velocities upon entering the separation chamber. As should be appreciated, the parallel, smooth flows and matched velocities prevent deleterious re-mixing of the separated particle species entrained in the curtain gas and those remaining in the particle flow after separation. Moreover, this flow pattern ensures that the curtain gas flow remains effective in carrying the selected charged particles drawn from the particle mixture in the first electric field zone to the first collector for recovery.

The first collector includes a first discharge outlet for discharging the recovered selected charged particles to a first collection bin. A transition outlet downstream of the first separation chamber delivers the particle flow remaining after passing through the first separator to a next-in-line separator. Alternatively, the remaining particle flow may be delivered directly to a second collection bin if further separation is unnecessary or undesired.

As noted above, the electric field zone is created between the conductor and the electrode by supplying a different electric potential to each to create a non-uniform electric field that serves to draw particles having a selected charge from the particle mixture. In the preferred embodiment, the conductor is cylindrical and is positioned or embedded in an outer wall of the separation chamber. The electrode is positioned at the center and may extend through the separation chamber only or, alternatively, from the first inlet, through the separation chamber, and into the discharge outlet. However, portions of the electrode outside of the separation chamber are preferably coated with a non-conductive material to prevent deleterious sparking between the walls of the inlet or outlet and the electrode.

In accordance with an important aspect of the present invention, the length of the electric field zone in the separation chamber is selectively adjustable, even during operation of the separation apparatus. This is accomplished by adjusting the relative position of an inner partition projecting into the separation chamber that actually defines the transition outlet and inlet for the next-in-line separator. By moving this inner partition upwardly into the separation chamber, the amount of the particle mixture flow that is exposed to the first electric field zone is reduced. This will of course result in a reduced draw of selected charged particles, unless the strength of the electric field force vector in the electric field zone is increased by increasing the potential difference between the electrode and conductor, such as by adjusting the magnitude of the charge supplied by the variable voltage source. By selectively adjusting the length and the strength of the electric field zone, optimum conditions can be easily achieved during operation to improve separation efficiency. Furthermore, as will be more readily understood from reviewing the disclosure which follows, by adjusting the electric field zone(s) in downstream separator(s), it is possible to further optimize the total amount of selected charged particles separated from the particle mixture by the apparatus and the number of stages required to acquire two substantially pure particle species.

In accordance with a more specific object of the present invention, a plurality of separators of the type described above may be included in a single electrostatic separation cell. More specifically, the particle flow remaining after the selected charged particles are recovered in a first separator is delivered through the transition outlet to a second separator. The second separator includes a second inlet for receiving the remaining particle flow, which may still contain selected charged particles not separated and carried away as the flow passed through the first separator.

To ensure that the remaining particle flow is adequately charged prior to entering the second separator, the discharge outlet defined by the partition tapers inwardly toward the second inlet to create a turbulent flow. Additionally, a spiral insert or the like may be provided in the second inlet for assisting in recreating turbulent flow. This promotes particle-particle and particle-wall contact which charges the particles. However, prior to exiting the second inlet, the particle flow is passed through a second flow vane for straightening. This ensures that the remaining particle flow is substantially parallel to a vertical axis of symmetry of the second inlet upon entering the second separation chamber.

Upon exiting the second inlet, the particle flow enters a second separation chamber. This second separation chamber includes a second electric field zone for drawing any remaining selected charged particles from the remaining particle flow. The second separation chamber may be substantially identical in construction to the first separation chamber, such that the second electric field zone is created by an electrode and a concentric conductor held at different electric potentials. The electrode in the second separation chamber may be an extension of the electrode in the first chamber, or alternatively, can be a separate segment. In the latter case, a separate variable voltage source can be connected between each segmented electrode and conductor. This arrangement allows for the potential difference across the electric field zone in each separator to be selectively adjusted to improve particle separation.

To carry away the selected charged particles drawn from the remaining particle flow, a second curtain gas flow is provided. The second curtain gas flows from a second curtain gas chamber concentric with the second inlet. Flow straighteners positioned near the exit of the second curtain gas chamber ensure that the second curtain gas flow remains substantially parallel to a vertical axis of the separation chamber prior to entering the second separator. Similar to the operation of the first separator, the second curtain gas flow entrains and carries the selected charged particles removed by the second electric field zone to a second collector for recovery. As the species of particles collected in the second separator are the same species that were removed in the first separator, the second collector is connected to a manifold in fluid communication for delivering the particles collected to the first collection bin.

As should be appreciated, a third separator similar in operation to the first and second separators described above may form a part of the electrostatic separation apparatus of the present invention. Furthermore, each electrostatic separation apparatus may include more than three separators arranged serially, depending on the types of particles being separated, the flow rate, the differential charges created on the particles, and other parameters. Preferably, the last separator in the separation apparatus includes a terminal outlet for discharging the particle flow remaining after the selected charged particles are fully removed to a second collection bin, which of course should be a substantially pure, commercially acceptable product consisting of only a single species of particles. Thus, after processing the particle mixture through the separation apparatus, the result is a single species of particles held in the first collection bin and a second species of particles held in the second collection bin.

In accordance with another more specific aspect of the present invention, a plurality of the electrostatic separation apparatus described above may be fed by a single distributor. Advantageously, this allows for simultaneous separation to occur to further enhance operational efficiency. In the preferred embodiment, the distributor is frusto-conical in shape and includes a plurality of discharge ports each corresponding to the first inlet of a electrostatic separation apparatus positioned adjacent to the distributor. Ideally, the particle mixture is tangentially introduced from the distributor into the separation apparatus to initiate turbulent flow to induce particle-particle and particle-side wall contact which creates the differential charging of the two particle species that is beneficial for particle separation.

Yet another more specific aspect of the invention is to include the plurality of electrostatic separation apparatus and the distributor in a particle separation system. In the preferred embodiment, the system includes a driving fluid source, such as a forced draft fan for blowing ambient air into a feed line supplying the distributor. The driving fluid source is positioned upstream of the distributor and an induction source, such as an induced draft fan, is provided downstream of the first and second collection bins to draw the driving fluid through the system. The action of the induced draft fan may also provide the source for the curtain gas flow for each separation stage. A feeder is provided in fluid communication with the forced draft fan for supplying the particle mixture to the distributor, which as described above is preferably frusto-conical in shape. The distributor assists in charging the particle mixture and then supplies a portion of the mixture to each of a plurality of electrostatic separation apparatus of the type described above including at least one, and preferably a plurality of, separators each having a collector. Each collector includes a discharge outlet for discharging the selected charged particles to a first collection bin, while the particle flow exiting the last-in-line separator is discharged through a terminal discharge outlet feeding a second collection bin. The first and second collection bins in turn discharge the particle flow to separate first and second collection devices, such as cyclone separators or the like for particle recovery. The first and second collection devices are in fluid communication with the downstream induced draft fan to draw the driving fluid, the particle mixture, and the particle flows through the plurality of electrostatic separation apparatus and eventually to the appropriate collection device for recovery.

A method of separating two species of particles from a particle mixture is also disclosed. In the broadest aspects of the method, the steps include feeding the particle mixture to a first inlet to create a turbulent particle mixture flow to electrostatically charge the particles, straightening the particle mixture flow, delivering the straightened particle mixture flow to a first separation chamber having a first electric field zone for drawing the selected charged particles therefrom, introducing a smooth curtain gas flow to the separation chamber substantially parallel to the particle mixture flow to entrain and carry the selected charged particles drawn from the particle mixture to a collector for recovery, and delivering the remaining particle flow to a second separator downstream of the first separator. Advantageously, by ensuring that the particle mixture and curtain gas flows remain substantially parallel, turbulence in the separation chamber is minimized, thereby resulting in enhanced separation efficiency.

Still other objects of the present invention will become apparent to those skilled in this art from the following description wherein there is shown and described a preferred embodiment of this invention, simply by way of illustration of one of the modes best suited to carry out the invention. As it will be realized, the invention is capable of other different embodiments and its several details are capable of modification in various, obvious aspects all without departing from the invention. Accordingly, the drawings and descriptions will be regarded as illustrative in nature and not as restrictive.

BRIEF DESCRIPTION OF THE DRAWINGS

The accompanying drawings incorporated in and forming a part of the specification, illustrate several aspects of the present invention and together with the description serve to explain the principles of the invention. In the drawings.

Reference will now be made in detail to the present preferred embodiment of the invention, an example of which is illustrated in the accompanying drawing.

DETAILED DESCRIPTION OF THE INVENTION

Figure 1:
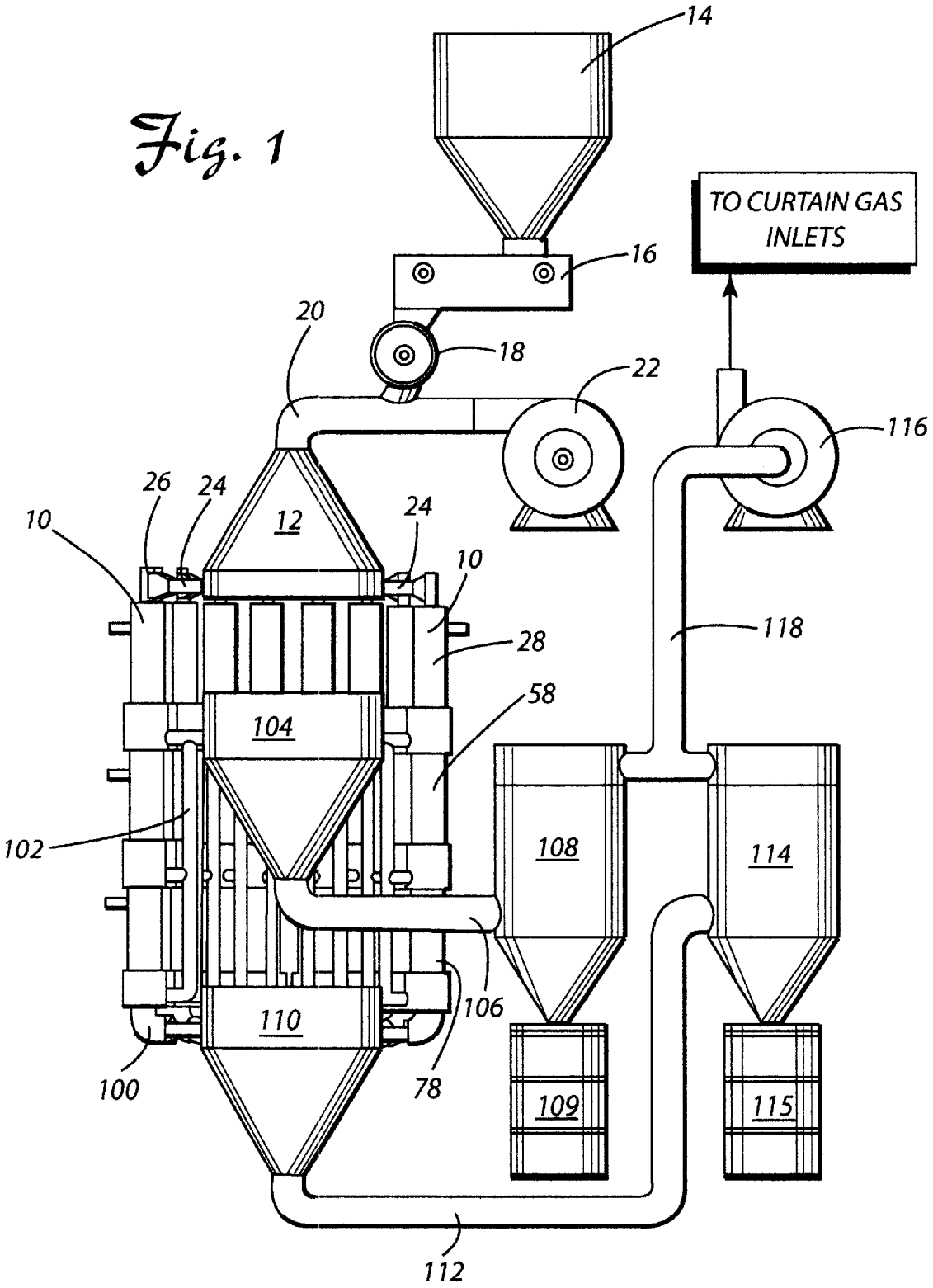
FIG. 1 is a schematic representation of the particle separation system including a plurality of cylindrical multistage electrostatic separation apparatus or cells positioned around a central frusto-conical distributor and first and second collection bins for recovering the two species of particles once separated.

Reference is now made to FIG. 1 showing a particle separation system S including a plurality of electrostatic separation apparatus in the form of cylindrical cells 10 surrounding a central distributor 12. The cells 10 may be used in the separation and purification of the mineral matter or pyrite constituents from the carbon constituents in finely-ground coal; ash constituents from carbon in coal combustion ash; specific minerals obtained from fine-sized mineral mixtures; heavy metal or radioactive components which are physically mixed in soils or other materials and ceramics contained in mixtures of ceramics, metals or organic polymers. In all cases, the terms "fine sized" or "finely ground" refer to particles having physical diameters in the range of 500 $\mu$m to approximately 0 $\mu$m and preferably, a diameter smaller than 75 $\mu$m. It should be appreciated that the apparatus is used for separating dry particles in contrast to wet particles or wet separation systems in which water or some other liquid with or without water is used to effect particle separation.

As shown in FIG. 1, the system S includes a holding tank 14 for receiving a particle mixture comprising two species of particles $P_1$ and $P_2$. The particle mixture is delivered by gravity from the holding tank 14 to a feeder 16, which in turn supplies metered quantities of the particle mixture through an air lock 18 to a feeder line 20. In the feeder line 20, the particle mixture encounters and is entrained in a driving fluid, such as ambient air, to create a particle mixture flow P. In the preferred embodiment, the driving fluid is supplied by a driving fluid source, such as a forced draft fan 22, positioned upstream of the feeder line 20. The fluid or gas is preferably ambient air, but other gases such as nitrogen, helium, argon, carbon dioxide, or combustion flue gas can be used at temperatures between approximately 25° C. to 300° C.

The feeder line 20 supplies the particle mixture flow P to the distributor 12, which is frusto-conical in shape. The distributor 12 is primarily where the particle mixture becomes tribocharged prior to entering the individual separation cells 10. As is known in the art, the extent to which the particle mixture is tribocharged depends on the flow behavior within the distributor 12. Preferably, to enhance tribocharging, the flow is turbulent to induce particle-particle and particle-wall contact, with the Reynolds Number, $R_e$, greater than 2300 (where $R_e = D \cdot V/\nu$, where D=the characteristic dimension of the distributor 12, V=the fluid flow velocity, and $\nu$=the kinetic viscosity of the fluid).

Figure 2:
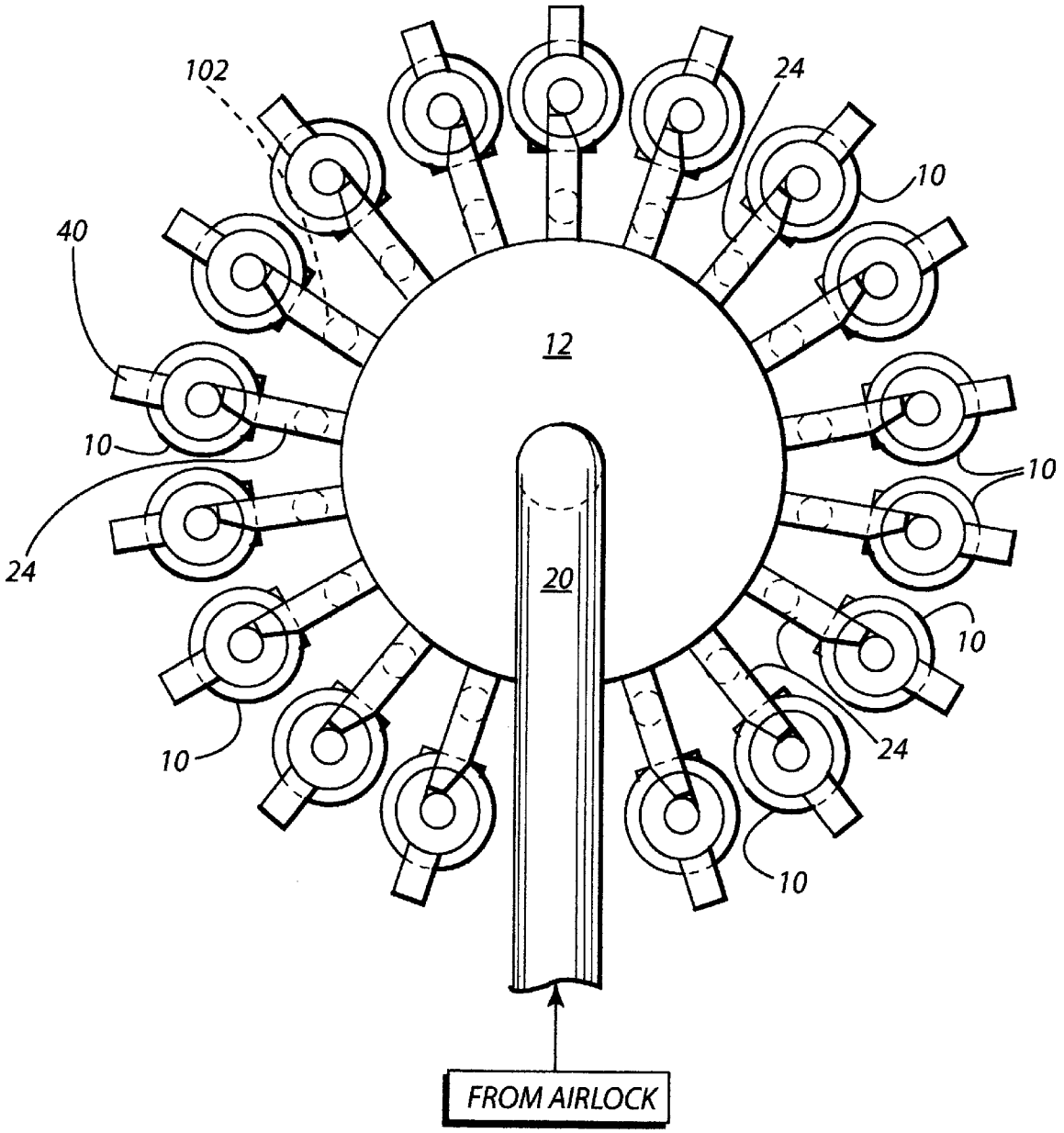
FIG. 2 is a top schematic view of the plurality of cylindrical multistage electrostatic separation cells surrounding the single central distributor.

As perhaps best shown in FIG. 2, the distributor 12 includes a plurality of discharge ports connected to supply lines 24 that deliver the entrained particle mixture flow P to each electrostatic separation cell 10. Preferably, the solid/gas mass ratio in the supply lines 24 leading to each cell 10 is about 1:1, but can vary from between 10:1 and 1:1000. The velocity of the particle mixture/gas flow in each supply line 24 is preferably near 10 m/s, but velocities between 1 and 50 m/s may also be employed. Of course, higher velocities impart greater differential charging of the particles by tribocharging action by maximizing the particle-particle and particle-wall collisions. As is known in the art, the supply lines 24 may be fabricated from or lined with a wear-resistant dielectrical material in order to selectively charge one of the species of particles to be separated while minimizing the charge on the other species or selectively charging both of the species with different polarities. A listing of suitable materials can be found in commonly assigned application Ser. No. 08/765,255, the full disclosure of which is incorporated herein by reference.

Figure 3:
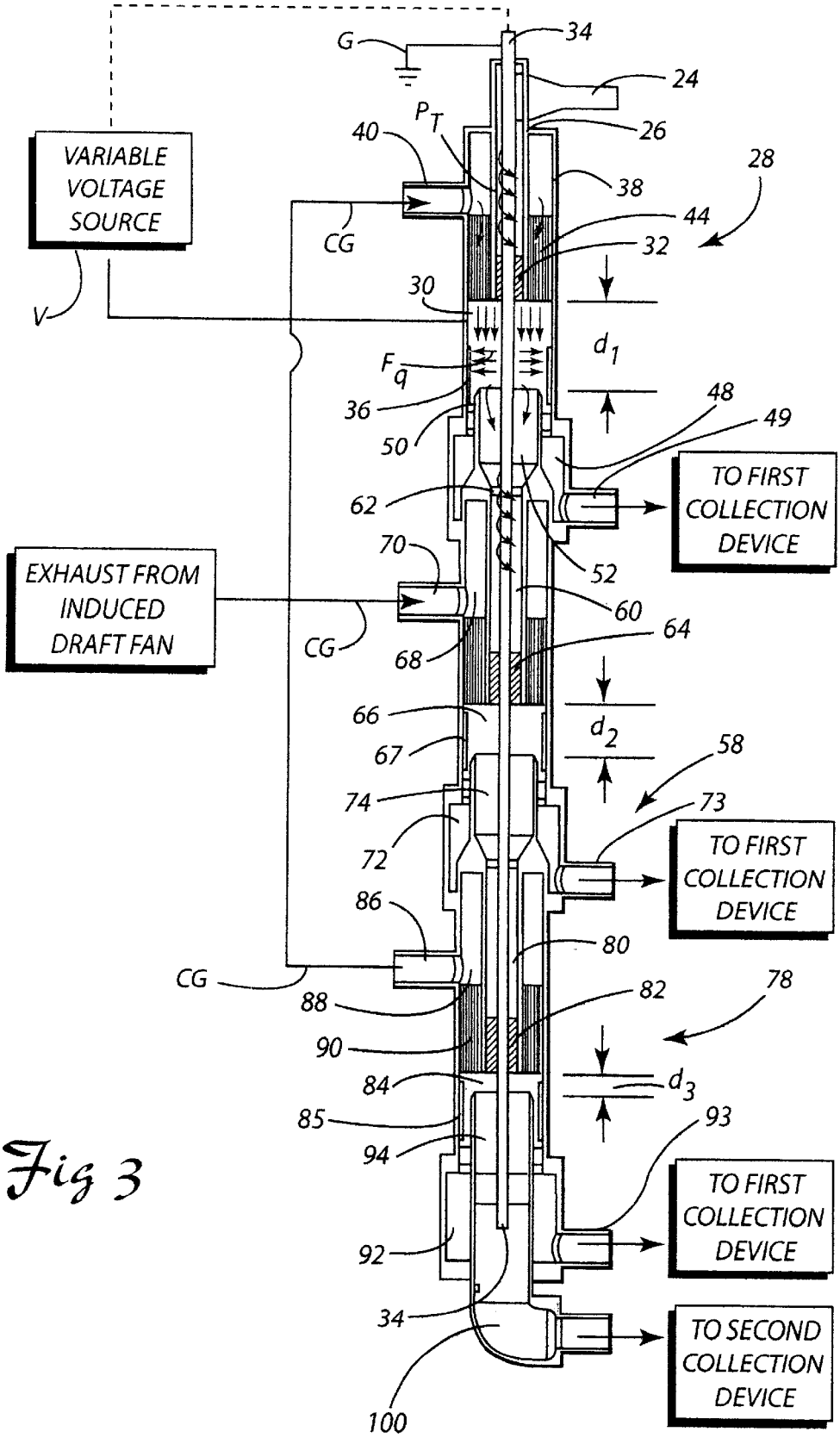
FIG. 3 is a partially schematic, cross-sectional side view of a single multistage electrostatic separation cell including first, second, and third separators in series.

Referring now to FIG. 3, each supply line 24 delivers the differentially charged particle mixture to a first inlet 26 that forms a part of the first separator 28 of each cell 10. Preferably, and as best illustrated by viewing FIGS. 2 and 3 together, the supply lines 24 introduce the particle mixture flow P tangentially into the first inlet 26, which creates a spiral, turbulent particle mixture flow $P_T$ (see spiral action arrows in inlet 26 shown in FIG. 3). This turbulent particle mixture flow $P_T$ promotes particle-particle and particle-wall contact to ensure that the beneficial differential charge remains on the two particle species in the particle mixture prior to electrostatic separation. Optionally, the particle mixture flow may be introduced from the top of the cell 10 or parallel to its axis of symmetry. Preferably, the first inlet 26 has a diameter of between 2.0 and 5.0 centimeters.

Referring now to FIG. 3, the construction of each electrostatic separation cell 10 is illustrated in detail. From the inlet 26, the turbulent particle mixture flow $P_T$ spirals downwardly toward a separation chamber 30 that performs the electrostatic particle separation. A plurality of flow vanes 32 positioned parallel to the axis of flow are provided at the exit of the first inlet 26. These vanes 32 serve to disrupt any tangential or spiral flow $P_T$ and ensure that substantially straight and smooth particle mixture flow $P_S$ is created upon entering the separation chamber 30 (see FIG. 4). The flow vanes 32 may be of any type known in the art, such as a grid or honeycomb-like structure or any other known device that can be used to straighten fluid flow.

To provide for the desired electrostatic separation, the separation chamber 30 includes an electric field zone having a non-uniform electric field. This electric field serves to draw the selected charged particles $P_1$ from the smooth-flowing particle mixture $P_S$ as it enters the separation chamber 30. In the preferred embodiment, the non-uniform electric field is created by an electrode 34 and a conductor 36 concentric with the electrode 34. The electrode 34 may be grounded G and the conductor in the separation chamber 30 attached to a variable voltage source V. Alternatively, the electrode 34 may be attached to a lead from the variable voltage source V (see dashed line in FIGS. 3, 4, and 5) to create the potential difference. Preferably, the voltage applied can be varied from between 0 to 50,000 volts.

In the preferred embodiment, the flow vane 32 in the first inlet 26 also serves the advantageous function of providing a guide for receiving and holding the electrode 34 in the proper position in the center of the cell 10. The electrode 34 may either extend from the top of the cell 10, along the first inlet 26 and through the separation chamber 30, as illustrated, or optionally may be formed in segments extending only the length of the individual separation chamber 30. In the former case, the portions of the electrode 34 housed in the inlet 26 and in close proximity to other outside structures are preferably coated with a non-conductive material, such as teflon, polyvinylchloride (PVC), rubber, or other elastomers, ceramic materials, or insulators. As should be appreciated, this coating decreases the incidence of voltage breakdown or sparking.

In the illustrated embodiment, the inner electrode 34 is grounded, while the outer, concentric conductor 36 carries a variable voltage to create a potential difference and hence an electric field between the two. Depending on the charge supplied to the outer conductor 36, the electric field force vector direction $F_q$ projects radially inwardly or radially outwardly. In the illustrated embodiment, for example, the charge on the conductor 36 may be positive, which will cause a radially outwardly directed force vector direction $F_q$ (see horizontal action arrows in separation chamber 30 in FIG. 3). This causes particles having a higher differential charge to be drawn toward the conductor 36 upon entering the separation chamber 30, while the lower differentially charged particles remain near the electrode 34. Although described in terms of oppositely charged particles, it should be appreciated that the attraction may occur where the particles are merely differentially charged.

As should be appreciated, the potential difference created in the electric field zone is beneficial in separating the two species of particles $P_1$, $P_2$ from the particle mixture P. Preferably, the length of the electric field zone is between 2 and 15 centimeters and is variable, as described in detail below, while the length of the outer wall of the separation chamber 30 is between 10 and 50 centimeters. The separation chamber 30 is between 4 and 50 centimeters in diameter (2 to 10 times greater than the diameter of the inlet). A most preferred ratio of the separation chamber diameter-to-inlet diameter is about 6:1.

Figure 4:
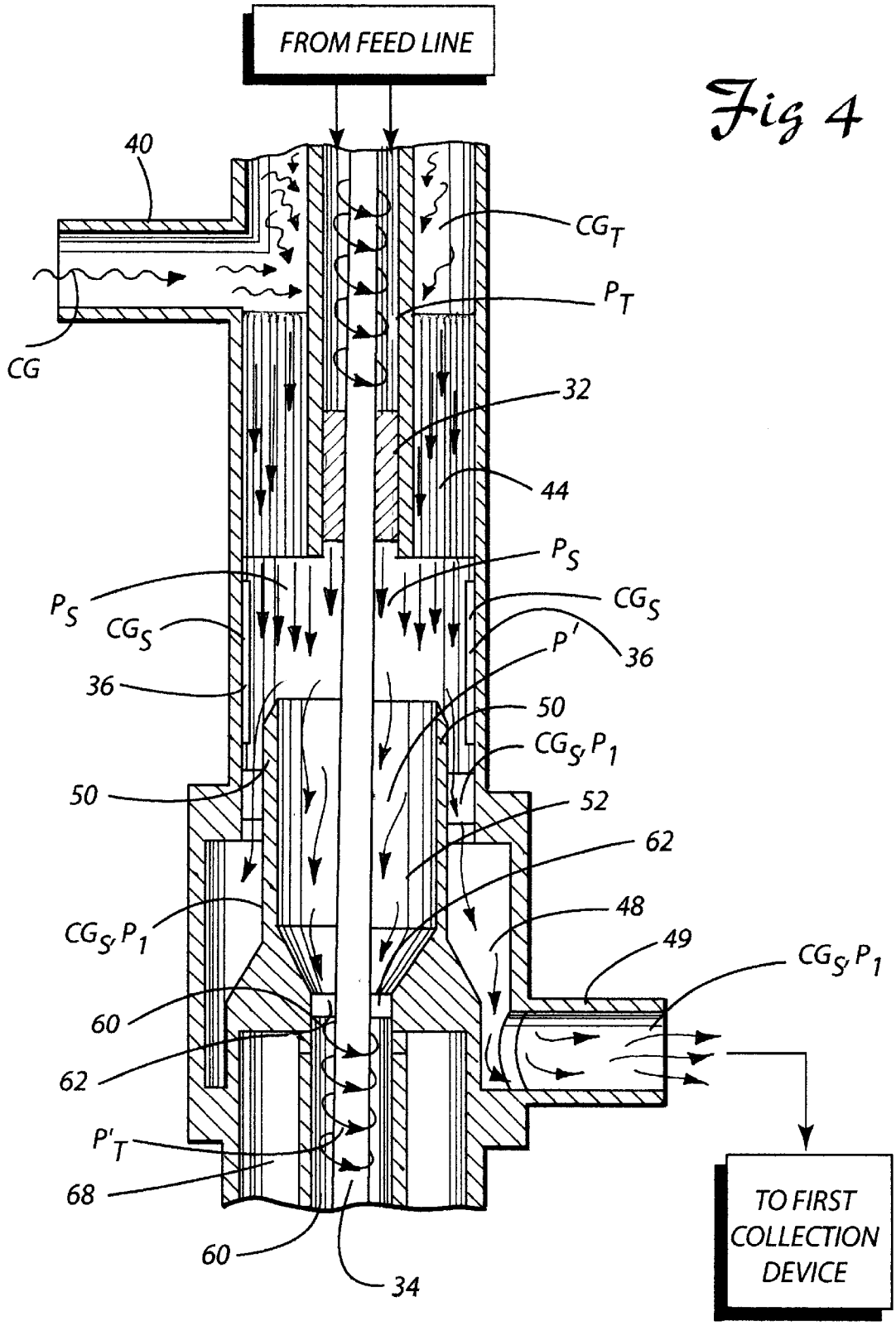
FIG. 4 is a partially schematic, cutaway cross-sectional side view of a portion of the electrostatic separation cell shown in FIG. 3, illustrating in particular the flow patterns of the curtain gas and the particle mixture from the separation chamber to the collector or transition outlet, respectively.

In accordance with an important aspect of the invention, the first separator 28 also includes a first curtain gas chamber 38 concentric with the first inlet 26 for supplying a curtain gas flow CG to the separation chamber 30. More specifically, the curtain gas chamber 38 includes a first curtain gas inlet 40 for delivering a curtain gas flow CG. As noted below, the curtain gas flow is preferably the exhaust from the downstream induced draft fan also forming a part of the system, but it is also possible to use a separate curtain gas source. The inlet 40 is preferably sized or metered so as to control the amount of curtain gas CG that is introduced. As shown in FIG. 4, upon entering the curtain gas chamber 38 from the inlet 40, the flow of the curtain gas is turbulent, as represented by reference symbol $CG_T$. Flow straighteners 44 positioned downstream from the curtain gas inlet 40 serve to reduce the turbulence and form a smooth curtain gas flow $CG_S$ that is parallel to the straightened particle mixture flow $P_S$ upon entering the separation chamber 30. Preferably, the flow straighteners 44 take the form of tubes having aspect ratios, i.e., the ratio of length to diameter, of greater than 20:1.

As the two previously separate flows $CG_S$ and $P_S$ come into contact, they remain parallel by virtue of the straightened, smooth flow patterns created just upstream of the separation chamber 30. To further ensure that the flows remain parallel, the velocities are preferably matched by using metering valves or the like (not shown). By doing so, any tendency to intermix is minimized, which advantageously reduces turbulence and improves separation efficiency. As a result of the two flows remaining discrete, the selected charged particles $P_1$ in the separation chamber 30 are freely drawn from the particle mixture P toward the conductor 36 and become entrained in the smooth curtain gas flow $CG_S$. This curtain gas flow $CG_S$ then moves straight toward a first collector 48 defined by an upstanding inner partition 50, where the separated particles $P_1$ are temporarily collected prior to recovery.

Figure 5:
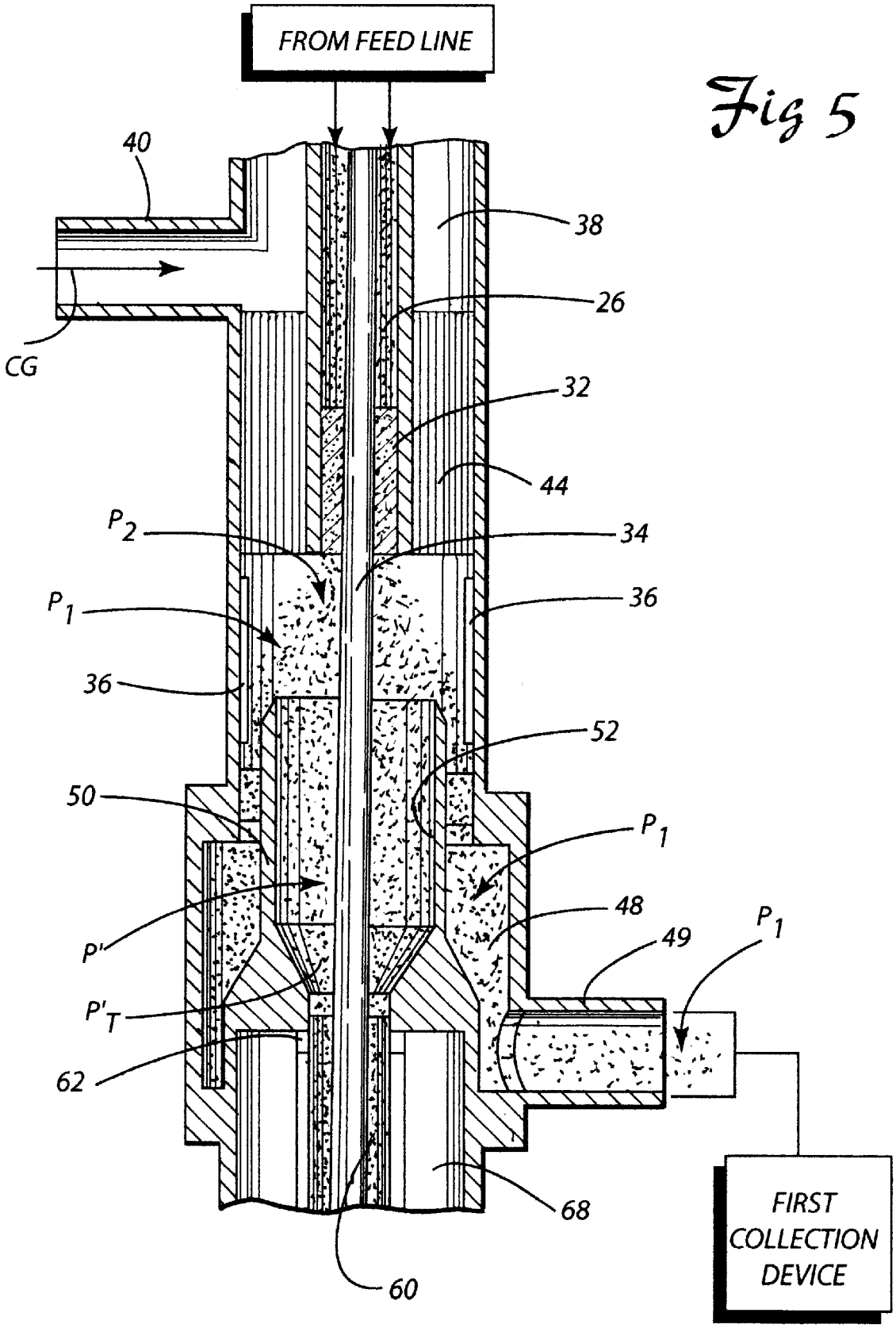
FIG. 5 is a partially schematic, cutaway cross-sectional side view similar to FIG. 4, but illustrating the separation of the selected charged particles from the particle mixture in the electric field zone, said selected charged particles then entrained in the curtain gas and carried to the collector downstream of the separation chamber for recovery.

As should be appreciated, the selected charged particles $P_1$ thus attracted by the conductor 36 are carried by the smooth, straightened curtain gas flow $CG_S$ to the first collector 48 for recovery (see FIGS. 4 and 5). The first collector 48 includes a discharge outlet 49 for delivering the flow of selected charged particles $P_1$ to collection devices, as described in further detail below. Preferably, the diameter of the discharge outlet 49 is at least equal to the diameter of the curtain gas inlet 40. This prevents any build-up of back pressure so that the collected selected charged particles $P_1$ do not flow back into the separation chamber 30 and, thus, further serves to reduce turbulence and the potential for deleterious re-mixing.

As best shown in FIGS. 4 and 5, the inner partition 50 that defines the inner wall of the first collector 48 also creates a cylindrical transition outlet 52. This transition outlet 52 receives the remaining particle flow P' exiting from the first separation chamber 30 and transitions it to the next-in-line, or second, separator 58, which may be identical in construction to the first separator 28. As should be appreciated, although the first separator 28 may remove all or a substantial amount of the selected particles depending on the size and strength of the electric field zone, the types of particles, the charges, and other factors, it is likely that the remaining particle mixture P' will include constituent particle species $P_1$ and $P_2$, thus requiring further separation to recover a substantially pure product.

To ensure that a proper charge is retained on the particles $P_1$ and/or $P_2$ in the remaining particle flow P' as the transition is made from the first separator 28 to the second separator 58, the transition outlet 52 preferably narrows to form the second inlet 60. This narrowing serves to reform the remaining particle flow P' thereby promoting particle-particle and particle-wall contact and creating a turbulent flow regime $P_T'$ to encourage tribocharging. To further assist in creating this turbulent flow $P_T'$, a spiral insert 62 or other type of flow diversion medium may be positioned between the transition outlet 52 of the first separator 28 and the second inlet 60. This insert 62 serves to directly disrupt the smooth flow of the remaining particle mixture flow P' and create particle-particle and particle-wall contact to recharge the particles.

As shown in FIG. 3, the second separator 58 is identical in construction and operation to the first separator 28. More specifically, prior to exiting the second inlet 60, the remaining particle mixture flow P' is passed through a flow vane 64 for straightening to ensure that it remains substantially parallel to a vertical centerline axis of the second inlet 60. Upon exiting the second inlet, the remaining particle flow P' enters a second separation chamber 66 including a second electric field zone having a concentric conductor 67 and an electrode 34 for drawing any remaining selected charged particles therefrom. A second curtain gas chamber 68 concentric with the second inlet 60 includes a second curtain gas inlet 70 for supplying a second curtain gas flow, which is also preferably the exhaust from the downstream induced draft fan (see below). This second curtain gas flow entrains and carries the selected charged particles removed in the second separation chamber 66 to a second collector 72 for recovery. A transition outlet 74 is also provided in the second separator 58 for discharging the remaining particle flow P" exiting from the second separation chamber 66.

It should be appreciated that each electrostatic separation cell 10 may include three or more individual separators arranged serially in stages, depending on the types of particles being separated, the flow rate, the charges on the particles, and other parameters. Thus, as illustrated in FIG. 3, a third separator 78 similar in operation to those described above may follow the second separator 58 for receiving the remaining particle flow P". Specifically, the third separator 78 includes a third inlet 80 having a third flow vane 82, a third separation chamber 84 including a third conductor 85 concentric with the electrode 34, a third curtain gas inlet 86 and chamber 88, for supplying a third curtain gas flow (which may be the exhaust from the induced draft fan forming a part of the system, as described further below), a third flow straightener 90, a third collector 92 for recovering the selected charged particles, and a third transition outlet 94. Each cylinder defining the next-in-line separator is connected in a telescoping fashion to the upstream separator. This allows for modular construction so that separators to be easily removed or added as necessary depending upon the particular application.

An important feature of the electrostatic separation apparatus 10 of the present invention is the ability to vary the length of the electric field zone in each separator. As illustrated by comparing the first and second separators 28, 58 in FIG. 3, the lower cylinder defining the partition 50 telescopes into the upper cylinder that defines the first curtain gas chamber 38, the first separation chamber 30, and the first collector 48. Thus, by moving the lower cylinder supporting the partition 50 relative to the upper cylinder, it is possible to vary the distance $d_1$ of the electric field to which the particle mixture flow is exposed. Movement of the lower cylinder can be accomplished by use of a motor-driven, translation screw device which is attached to the outside wall of the lower cylinder. Such a device is available commercially. The translation direction is parallel to the axis of the cylinders. Upon movement of the lower cylinder, during which time the distance d1 is varied, the distance d2 is also varied. Hence, it is advisable to use synchronizable translation devices which are attached to each separation chamber and which enable either synchronized translation of each chamber, i.e. movement in which d1 can be changed while d2 and d3 are kept constant, or independent translation of each chamber, i.e. movement in which d1, d2 and d3 can be independently varied to greater or lesser lengths. Thus, as illustrated with the second separator in FIG. 3, the distance $d_2$ may be reduced because not as many selected particles are present for removal. In addition to improving efficiency, this also allows for adjustments to be made to fine tune the separation action. For example, if the distance of the electric field zone is particularly long, such as $d_1$, the potential difference required to draw the selected charged particles from the particle mixture flow P is reduced. In contrast, if the distance of the electric field zone is reduced, such as at $d_2$ or $d_3$, a greater potential difference is required to provide the same particle extraction force. By adjusting the lengths and potential difference accordingly, it is possible to ensure that optimum separation efficiency is achieved in each separator.

It should also be appreciated that it is possible to vary the potential difference provided across the electric field zone within each separator by connecting a variable voltage source V to each individual conductor 36. Also, where the electrode 34 is segmented, it is also possible to connect one lead of a separate variable voltage source to each segment to vary the potential difference across each electric field zone. Moreover, in downstream separators, it is possible to conserve energy and reduce overall processing costs by de-energizing the electric field if further separation is found to be unnecessary.

To recover the particle species from the collectors 48, 72, 92 in each cell 10, a discharge outlet 49, 73, 93 is provided in fluid communication with a collection manifold 102 (see FIG. 1). In the illustrated embodiment, each collection manifold 102 preferably corresponds to a single cell 10 and includes port(s) corresponding to each collector 48, 72, 92. The collection manifold 102 itself is in fluid communication with a first collection bin 104 or a similar collection device. Preferably, the first collection bin 104 is inverted and frusto-conical such that it discharges the flow containing the collected species of particles $P_1$ through a first transition tube 106. The transition tube 106 delivers this particle flow $P_1$ to a first cyclone separator 108 or similar apparatus, such as a bag filter, for removing the particles from the flow of the driving fluid. The substantially pure species of particles $P_1$ is then discharged to a holding drum 109 or the like, ready for use.

To recover the particle species $P_2$ discharged by the discharge outlet 100 in the last-in-line separator, such as the third separator 78, a second collection device or bin 110 preferably similar in construction to the first collection bin 104 is provided. A second transition tube 112 delivers the particle flow $P_2$ from the second collection bin to a second cyclone separator 114 or similar apparatus. The substantially pure particle species $P_2$ separated from the driving fluid in the cyclone separator 114 is then discharged to a holding drum 115 or the like, also ready for use.

To assist in drawing the particle flow through the system S, an induction source, such as an induced draft fan 116, is provided downstream of the separation cells 10, and most preferably downstream of the cyclone separators 108, 114. In the preferred embodiment, the induced draft fan 116 is connected to an induction tube 118 in simultaneous fluid communication with the first and second cyclone separators 108, 114. Thus, the forced draft fan 22 and induced draft fan 116 operate in concert to insure that particles are efficiently moved through the apparatus. By using the exhaust from the induced draft fan 116 to supply the curtain gas flow CG for each separation stage, a completely self-contained system may be provided.

In summary, numerous benefits may be realized by employing the concepts of the presently proposed electrostatic separation system S, including an improved electrostatic separation cell 10 for separating two species of particles from a particle mixture. The system improves operational efficiency by using a single distributor 12 to tribocharge and supply the particle mixture to a plurality of electrostatic separation cells 10. Each cell 10 includes at least one separator 28 including an inlet 26 and a separation chamber 30 having an electric field zone for drawing selected charged particles from the particle mixture. Advantageously, the length of the electric field zone is selectively adjustable for varying the charged particle drawing action. A curtain gas flow is introduced into the separation chamber 30 to carry the selected charged particles drawn from the particle mixture to a collector 48. To improve separation efficiency, flow straighteners 32, 44 are provided for both the particle mixture flow and the curtain gas flow to reduce turbulence in the separation chamber 30. The collector 48 includes a discharge outlet 49 for discharging the selected charged particles to a first collection bin 104. A transition outlet 100 is also provided downstream of the separation chamber 84 that allows the particle flow exiting therefrom to be recovered in a second collection bin 110 or passed to a second separator 58 to further separate and collect the selected charged particles remaining in the particle flow. To improve separation effectiveness in the second separator, the particle flow exiting through the transition outlet 100 may be remixed to promote particle-particle and particle-wall contact for tribocharging the particles and then straightened prior to entry. Using the exhaust from an induction source 116 used to draw the particle flow through the system S as the curtain gas CG also allows for a completely self-contained system to be provided.

The foregoing description of a preferred embodiment of the electrostatic separation cell 10 and system S of the present invention has been presented for purposes of illustration and description. It is not intended to be exhaustive or to limit the invention to the precise form disclosed. Obvious modifications or variations are possible in light of the above teachings. The embodiment was chosen and described to provide the best illustration of the principles of the invention and its practical application to thereby enable one of ordinary skill in the art to utilize the invention in various embodiments and with various modifications as are suited to the particular use contemplated. All such modifications and variations are within the scope of the invention as determined by the appended claims when interpreted in accordance with the breadth to which they are fairly, legally and equitably entitled.

What is claimed is:

1. A method for separating and removing a first species of electrostatically charged particles from a particle mixture flow including at least a second species of particles, comprising the steps of:

feeding the particle mixture flow to a first inlet of a separator to create a turbulent particle mixture flow to assist in electrostatically charging the particles;

straightening and smoothing the turbulent particle mixture flow;

delivering the particle mixture flow to a first separation chamber having a first electric field zone for drawing a species of particles having the selected charge from the smooth particle mixture flow;

introducing a curtain gas flow to the separation chamber parallel to the smooth particle mixture flow to entrain and carry the species of particles having the selected charge drawn from the smooth particle mixture flow to a collector for recovery, delivering a remaining particle flow to a second separation chamber having a second electric zone for drawing any species of particles having the selected charge therefrom, collecting the remaining particle flow;

whereby the substantially parallel smooth flows reduce turbulence and improve separation of the species of particles having the selected charge from the particle mixture.

2. The method according to claim 1, wherein the step of delivering the remaining particle flow to a second separation chamber includes the steps of first feeding the particle flow to a second inlet to create a second turbulent particle flow to electrostatically recharge the particles and then straightening the second particle turbulent flow prior to entering the second separation chamber.

3. An apparatus for separating a species of particles having a selected electrostatic charge from a particle mixture flow including a first species and at least one second species of particles entrained in a driving fluid, comprising:

a distributor for receiving and assisting in creating a differential charge on the two species of particles forming the particle mixture flow; and a plurality of electrostatic separation cells positioned in a parallel relationship, each having a first separator including a first inlet for receiving the particle mixture flow from said distributor, a first separation chamber having a first electric field zone for drawing the species of particles having the selected charge from the particle mixture flow, and a first curtain gas chamber concentric with said first inlet, said first curtain gas chamber having a first curtain gas inlet for receiving a first curtain gas flow for entraining and carrying away the species of charged particles having the selected charge drawn from the particle mixture flow in the first electric field zone to a first collector for recovery, whereby separation efficiency may be greatly improved by simultaneously processing the particle mixture flow in each of the plurality of separation cells in parallel with carrying away of the selected charged particles by the first curtain gas flow in each separator.

4. The electrostatic separation apparatus according to claim 3, wherein said distributor is frusto-conical.

5. The electrostatic separation apparatus according to claim 3, further including a supply line for tangentially introducing said particle mixture flow received from the distributor into each said first inlet to create a turbulent or spiraling flow to assist in differentially charging the particles in the particle mixture flow.

6. The electrostatic separation apparatus according to claim 5, wherein said first inlet includes a flow vane to disrupt and realign the particle mixture flow substantially parallel to a vertical axis of said first inlet prior to exiting therefrom.

7. The electrostatic separation apparatus according to claim 6, wherein said first separation chamber further includes a first electrode and a first conductor concentric with said first electrode, said first electrode and first conductor having differential charges to create a non-uniform electric field in said first electric field zone for drawing the species of particles having the selected charge from the particle mixture.

8. The electrostatic separation apparatus according to claim 7, wherein said first electrode extends concentrically along said first inlet and through said first separation chamber, a portion of said first electrode in said first inlet coated with a non-conductive material to prevent sparking.

9. The electrostatic separation apparatus according to claim 8, wherein said flow vane includes a center aperture that receives and provides alignment for said first electrode in said first inlet.

10. The electrostatic separation apparatus according to claim 3, wherein said first curtain gas chamber includes at least one flow straightener to realign the first curtain gas flow substantially parallel to the vertical axis of said first inlet prior to entering said first separation chamber, whereby said first curtain gas flow and particle mixture flows are substantially parallel upon entering said first electric field zone to reduce turbulence and improve separation efficiency.

11. The electrostatic separation apparatus according to claim 3, wherein the length of said first electric field zone is selectively adjustable.

12. The electrostatic separation apparatus according to claim 3, wherein said first collector includes a first discharge outlet for discharging the species of particles having the selected charge to a first collection bin.

13. The electrostatic separation apparatus according to claim 3, wherein said first separator further includes a first transition outlet for discharging a first remaining particle flow;

each of said plurality of electrostatic separation cells further including a second separator downstream of said first separator, said second separator including a second inlet for receiving the first remaining particle flow discharging from said first transition outlet, a second separation chamber for receiving the first remaining particle flow from said second inlet, said second separation chamber having a second electric field zone for drawing any remaining particles of the species of particles having the selected charge from the first remaining particle flow, and a second curtain gas chamber concentric with said second inlet, said second curtain gas chamber having a second curtain gas inlet for receiving a second curtain gas flow for entraining and carrying the species of particles drawn from the first remaining particle flow to a second collector for recovery.

14. The electrostatic separation apparatus according to claim 13, wherein said second inlet is provided with an insert for creating a turbulent flow to triboelectrically recharge the first remaining particle flow exiting the first separator and a flow vane to realign the first remaining particle flow substantially parallel to the vertical axis of said second inlet prior to exiting therefrom.

15. The electrostatic separation apparatus according to claim 13, wherein said first collector includes a first discharge outlet for discharging the particles collected therein to a first collection bin and said second collector includes a second discharge outlet in fluid communication with said first outlet for discharging the remaining particles to said first collection bin.

16. The electrostatic separation apparatus according to claim 13, wherein said second separator further includes a second transition outlet for a second remaining particle flow;

each of said plurality of electrostatic separation cells further including a third separator downstream from said second separator, said third separator including a third inlet for receiving the second remaining particle flow discharging from said second transition outlet, a third separation chamber having a third electric field zone for drawing any remaining species of particles having the selected charge from the second remaining particle flow, and a third curtain gas chamber having a third curtain gas inlet for receiving a third curtain gas flow for entraining and carrying the particles drawn from the second remaining particle flow to a third collector for recovery.

17. The electrostatic separation apparatus according to claim 16, wherein said first collector includes a first discharge outlet for discharging the species of particles having the selected charge to a first collection bin and said third collector includes a third discharge outlet in fluid communication with said first discharge outlet for discharging the species of particles having the selected charge to said first collection bin.

18. The electrostatic separation apparatus according to claim 17, wherein said third separator includes a terminal outlet for discharging a third remaining particle flow to a second collection bin.

19. A multistage electrostatic apparatus for separating and removing a selected first species of electrostatically charged particles from a particle mixture including at least one second species of particles, comprising:

a feeder for supplying the particle mixture;

a pressurized driving fluid source for supplying a driving fluid to entrain the particle mixture supplied by said feeder;

a distributor for receiving the entrained particle mixture from the feeder;

a plurality of cells positioned in a parallel relationship, each having a first separator including a first inlet for receiving a portion of the entrained particle mixture from said distributor, a first separation chamber having a first electric field zone for drawing the species of particles having a particular charge from the particle mixture, and a first curtain gas inlet for introducing a first curtain gas into said first separation chamber to entrain and carry the species of particles having the selected charge to a first collector for recovery;

each of said cells further including a second separator downstream of said first separator having a second inlet for receiving the particle mixture from the first separator, said second separator including a second separation chamber having a second electric field zone for drawing the species of particles having the selected charge remaining in the particle mixture and a second curtain gas inlet for introducing a second curtain gas into the second separation chamber to entrain and carry the species of particles having the selected charge to a second collector for recovery;

a first collection device for receiving the particles from said first and second collectors;

a second collection device for receiving a particle flow remaining after said species of particles having the selected charge are removed by said first and second separators; and an induction source in fluid communication with said first and second collection devices for drawing the driving fluid through the apparatus.

20. The system according to claim 19, wherein said induction source includes an exhaust port, wherein the driving fluid exhausted from the induction source serves as the source for the first curtain gas.

21. A multistage electrostatic separation cell for use in separating and recovering a species of electrostatically charged particles having a selected charge from a particle mixture flow comprised of the first species of particles and at least one second species of particles, said particle mixture flow entrained in a dry driving fluid, and supplying the non-selected species of particles to a collection device for recovery, comprising:

a first separator including a first inlet having a first non-electrically charged flow vane for straightening and smoothing the particle mixture flow prior to entering a first separation chamber having a first electric field zone for drawing the species of particles having the selected charge from the particle mixture flow, said first separator further including a first curtain gas chamber including a flow straightener for supplying a smooth first curtain gas flow parallel to the smooth particle mixture flow, said curtain gas flow entraining and carrying the species of particles having the selected charge drawn from the particle mixture flow in the first electric field zone to a first collector for recovery, and a first transition outlet; and a second separator downstream of said first separator including a second inlet for receiving a remaining smooth particle flow from said first transition outlet, separating any remaining particles having the selected charge from the particle flow, and supplying the separated particles to a second collector, and a second outlet for discharging a second remaining particle flow for recovery by the collection device.

22. The multistage electrostatic separation cell according to claim 21, wherein the second inlet is adapted for receiving and disrupting the remaining smooth particle flow including at least the non-selected species of particles exiting from said first transition outlet to remix and thereby recharge the particles, said second inlet further including a second flow vane for straightening and smoothing the remaining particle flow;

a second separation chamber for receiving the remaining smooth particle flow from said second inlet, said second separation chamber having a second electric field zone for drawing any of the species of particles having the selected charge from the remaining particle flow;

a second curtain gas chamber including a flow straightener for supplying a smooth second curtain gas flow parallel to the remaining particle flow for entraining the remaining species of particles having the selected charge to said second collector for recovery.

23. The multistage electrostatic separation cell according to claim 1, wherein said first and second separators are modular components and the first transition outlet of the first separator includes an opening adapted for receiving the second inlet of the second separator in a telescoping fashion.

* * * * *

UNITED STATES PATENT AND TRADEMARK OFFICE

CERTIFICATE OF CORRECTION

PATENT NO. : 6,498,313 B1
DATED : December 24, 2002
INVENTOR(S) : John Stencel et al.

It is certified that error appears in the above-identified patent and that said Letters Patent is hereby corrected as shown below:

Column 11,
Line 5, replace "to" with -- may --.

Column 16,
Line 61, replace "1" with -- 21 --.

Signed and Sealed this

Sixteenth Day of September, 2003

JAMES E. ROGAN
*Director of the United States Patent and Trademark Office*